US006907753B2

(12) United States Patent
Lieberman

(10) Patent No.: US 6,907,753 B2
(45) Date of Patent: Jun. 21, 2005

(54) INTERCHANGEABLE JEWELRY SETTING

(76) Inventor: Silas Lieberman, Kone Leem St 19, 2018 Antwerp (BE)

( * ) Notice: Subject to any disclaimer, the term of this patent is extended or adjusted under 35 U.S.C. 154(b) by 0 days.

(21) Appl. No.: 10/281,073

(22) Filed: Oct. 23, 2002

(65) Prior Publication Data

US 2003/0121282 A1 Jul. 3, 2003

Related U.S. Application Data

(63) Continuation of application No. PCT/US02/09081, filed on Mar. 22, 2002.
(60) Provisional application No. 60/278,313, filed on Mar. 23, 2001.

(51) Int. Cl.[7] ..... A44C 17/02
(52) U.S. Cl. ..... 63/29.1; 63/26
(58) Field of Search ..... 63/26, 29.1

(56) References Cited

U.S. PATENT DOCUMENTS

| | | | | | |
|---|---|---|---|---|---|
| 1,160,723 | A | | 11/1915 | Lander | |
| 1,176,028 | A | * | 3/1916 | Botfield | 63/29.1 |
| 1,529,606 | A | * | 3/1925 | O'Donnell | 63/29.1 |
| 1,592,561 | A | * | 7/1926 | Godley | 362/339 |
| 1,864,371 | A | | 6/1932 | Prussian | |
| 3,039,279 | A | | 6/1962 | Van Bussel | |
| 3,307,375 | A | | 3/1967 | Estrin et al. | |
| 3,568,467 | A | | 3/1971 | Ellison | |
| 3,933,011 | A | | 1/1976 | DiGilio et al. | |
| 4,168,586 | A | * | 9/1979 | Samis | 63/15 X |
| 4,374,470 | A | | 2/1983 | Isaacson | |
| 4,436,328 | A | | 3/1984 | Chernosky | |
| 4,982,581 | A | | 1/1991 | Furuyama | |
| 5,285,659 | A | * | 2/1994 | Bardisbanyan | 63/26 |
| 5,375,434 | A | | 12/1994 | Wertheimer et al. | |
| 5,456,095 | A | | 10/1995 | Tawil et al. | |
| 5,588,310 | A | | 12/1996 | Lai | |
| D409,517 | S | | 5/1999 | Itzkowitz | |
| 5,992,177 | A | * | 11/1999 | Beard | 63/29.1 |
| 6,000,888 | A | | 12/1999 | Hartman | |
| 6,484,537 | B2 | * | 11/2002 | Takessian | 63/29.1 |
| 6,490,886 | B1 | * | 12/2002 | Steinhauer et al. | 63/15 |

FOREIGN PATENT DOCUMENTS

| | | |
|---|---|---|
| FR | 1 378 979 | 10/1964 |
| GB | 1299856 | 12/1972 |
| GB | 2 215 181 | 9/1989 |

OTHER PUBLICATIONS

International Preliminary Report dated Oct. 1, 2004.

* cited by examiner

*Primary Examiner*—JJ Swann
*Assistant Examiner*—Thomas Ho
(74) *Attorney, Agent, or Firm*—Katten Muchin Zavis Rosenman

(57) ABSTRACT

An article of jewelry has a jewelry setting for removable engagement of a jewel from such article of jewelry. The jewelry setting enables biased engagement of the jewel with the article of jewelry in a secure manner, such that inadvertent separation of the jewel from the article of jewelry is prevented. A special tool for the engagement of the jewel with the jewelry article may be provided to enhance the secure connection between the jewel and article of jewelry. An interchangeable system of jewels, settings and articles of jewelry is also provided.

31 Claims, 12 Drawing Sheets

INTERCHANGEABLE JEWELRY SETTING

CROSS REFERENCE TO RELATED APPLICATIONS

This is a continuation of International Application PCT/US02/09081 filed Mar. 22, 2002, which claimed the benefit from provisional application Ser. No. 60/278,313 filed on Mar. 23, 2001.

FIELD OF THE INVENTION

This invention relates to jewelry settings generally, and more specifically to a jewelry setting having interchangeable parts that are rotationally biasable together.

BACKGROUND OF THE INVENTION

Jewelry pieces are conventionally permanent. In other words, once a jewel is fixed within a setting, the jewel and the setting may only be used or worn as a combined unit on one part of the body. This can be quite limiting, for example, if one wished to display or wear a particular jewel on one's finger during one occasion and on one's clothing in a brooch or pin during another occasion.

Interchangeable jewelry settings that overcome such a limitation are known. Usually, interchangeable jewelry settings allow a variety of stones or jewels to be used with a single setting. Alternatively, a single jewel or stone can be used in a variety of settings for adornment in a variety of locations. An early example is shown in U.S. Pat. No. 1,864,371 to Prussian.

Most prior art interchangeable jewelry settings incorporate a first setting piece having a jewel fixed thereto and a second setting piece into which such first setting piece is secured for as long as the user wants it in that piece of jewelry. The first setting piece may be threadingly engaged with the second setting piece, as shown in U.S. Pat. No. 1,160,723 to Lander. Other manners of engagement are shown in U.S. Pat. No. 4,982,581 to Furuyama, U.S. Pat. No. 5,588,310 to Lai, and U.S. Pat. No. 3,933,011 to DiGilio et al. Another popular method is shown in U.S. Pat. No. 5,456,095 to Tawil et al., wherein a bayonet-type locking arrangement having ramped engagement portions is used to secure the first setting within the second setting.

In each of the prior art references noted above, there is a chance that the first and second pieces may be inadvertently separated through hand manipulation. Such possibility arises from the downward placement of the first setting piece, having the jewel fixed thereto, into the second setting piece into which such first setting piece is placed. In such an arrangement, the engagement and disengagement of the first and second setting pieces may easily occur while the article of jewelry is being worn. While this arrangement may be convenient if it is desired to swiftly change gems or diamonds, it lacks a certain amount of security. Furthermore, because the engagement of the first and second pieces occurs primarily by hand, there are no security measures inherent in the structures of the prior art that prevent unwanted disengagement of the first and second pieces.

The setting of the present invention overcomes the inadequacies of the prior art by providing a secure means for releasable and interchangeable engagement of a gem with a jewelry piece. The construction of the setting prevents unwanted removal of the gem from the setting while the jewelry article is being worn and displayed by requiring engagement of the gem with the setting from the inside of the setting, not the outside of the setting. Thus, for example, if the jewelry item is a ring worn on a person's finger, the gem can only be inserted into the ring through the interior of the ring and not from the outer periphery of the ring. In addition, the gem is preferably engaged and disengaged from the setting by a special tool, which must preferably be used to insert, remove and interchange gems with the setting. Thus, unwanted disengagement of the gem from the setting is prevented because only the owner of the jewelry article would have possession of the tool.

OBJECTS OF THE INVENTION

It is an object of the present invention, therefore, to provide a jewelry setting having an interchangeable gem setting.

It is a further object of the present invention to provide a jewelry setting having an interchangeable gem setting that is rotatingly engageable with the jewelry article.

It is a further object of the present invention to provide a jewelry setting wherein the gem or jewel is spring-engaged with an article of jewelry.

It is a further object of the present invention to provide a jewelry setting that prevents inadvertent disengagement of a gem or jewel from an article of jewelry.

It is a further object of the present invention to provide a jewelry setting that preferably requires the use of a special tool for engagement and disengagement of a jewel or gem from the article of jewelry.

Still other objects and advantages of the invention will become clear upon review of the following detailed description in conjunction with the appended drawings.

SUMMARY OF THE INVENTION

An article of jewelry has a jewelry setting for removable engagement of a jewel from such article of jewelry. The jewelry setting enables biased engagement of the jewel with the article of jewelry in a secure manner, such that inadvertent separation of the jewel from the article of jewelry is prevented. Additional security measures, such as requiring the use of a special tool for the engagement of the jewel with the jewelry article, may be designed into the construction of the jewelry setting. The jewelry setting enables a plurality of jewels to be interchangeably set within the article of jewelry, thus enabling the appearance of the article of jewelry to be changed as desired. In addition, various jewelry settings may also be incorporated into various articles of jewelry, such that jewels engageable with such settings and such articles of jewelry can be used interchangeably.

DETAILED DESCRIPTION OF THE PREFERRED EMBODIMENTS

Figure 1:
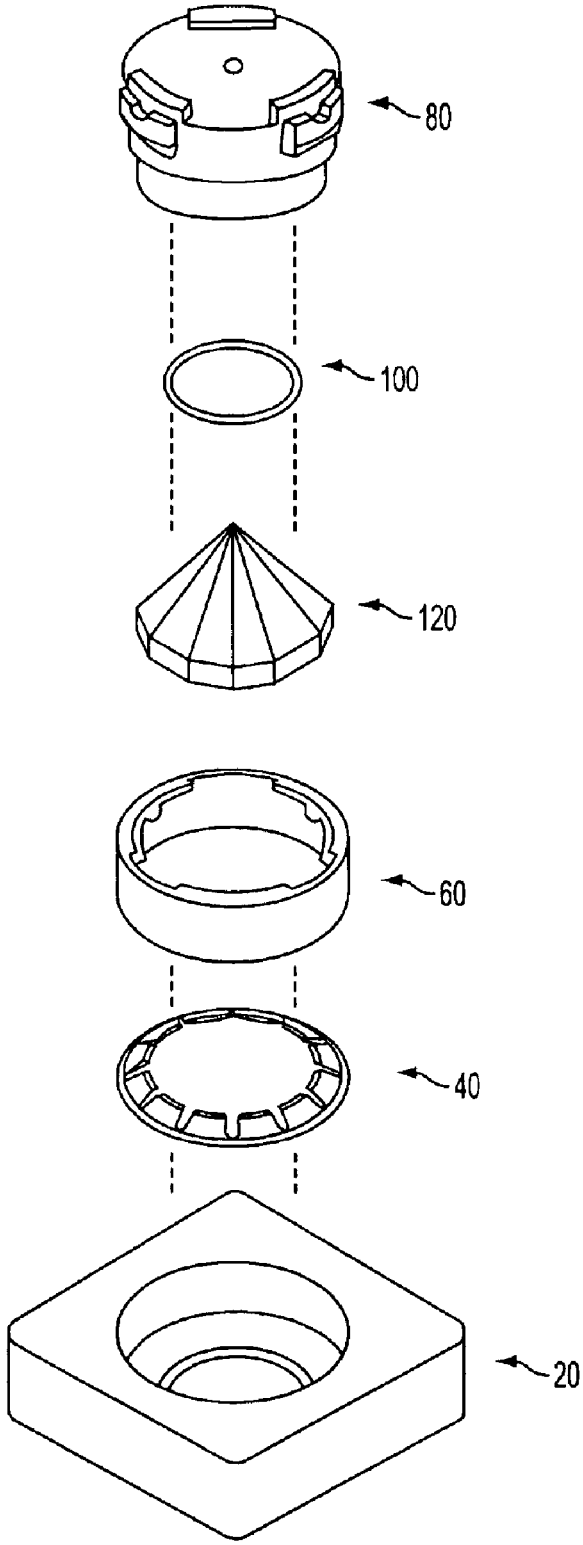
FIG. 1 is an exploded view of the components of the jewelry setting of the present invention.

The jewelry setting of the present invention is designed to provide a consumer with the ability to optimize and maximize the use and enjoyment of a jewel or gem. Normally, a jewel is purchased in connection with a single article of jewelry, which can only be worn on a single body part. This can be quite restrictive and prevent the user from wearing the jewel on more than only a few selected occasions. By allowing a user to securely interchange jewels with different jewelry articles, the user is no longer prevented from wearing a jewelry article in only one environment. Thus, a jewel may be worn on a ring one day, one a bracelet the next day, on a pin the day after, and in earrings the day after that. Or, a jewel may be used interchangeably with different jewelry articles throughout a single day. Accordingly, a user owning a plurality of different jewels and a plurality of different jewelry articles can create many jewelry articles having many different appearances. This provides the user with a variety of choices and options that are not possible with a jewelry article having a jewel fixed therein.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 is an exploded view of a jewelry article employing the jewelry setting of the present invention, generally comprising an article of jewelry 20, such as a ring, pin, brooch, bracelet or the like, a spring 40, an insert 60, a setting 80, a washer or spring 100 and a jewel or gem 120. For purposes of illustration and explanation, the article of jewelry 20 will be shown in representative form as a square piece, it being understood that such article of jewelry 20 can be a portion of a ring, pin, etc. The assembly is completed by engaging the "male" part, defined by the assembly of the gem 120 seated within the setting 80, with the "female" part defined by the assembly of the insert 60 and spring 40 both seated within the article of jewelry 20.

Figure 2:
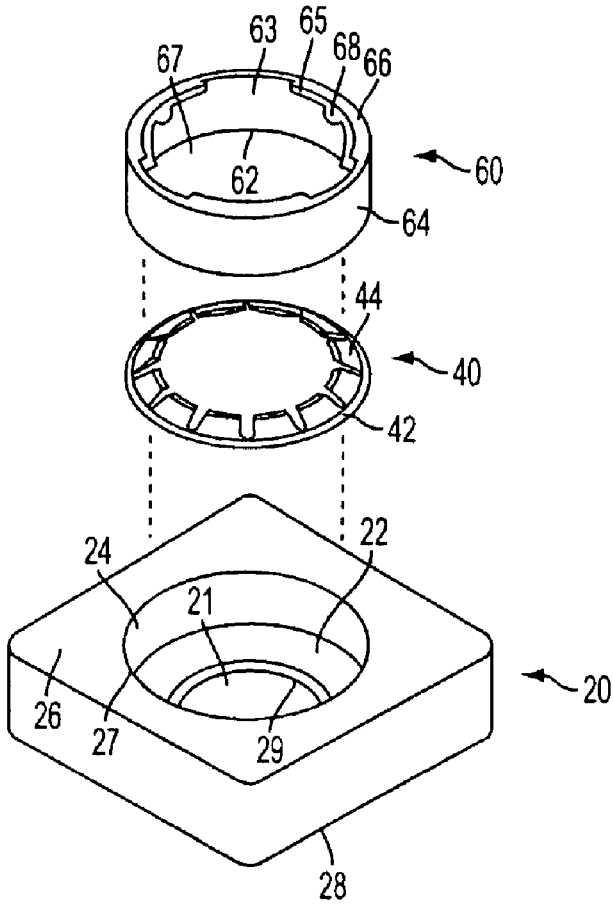
FIG. 2 is an exploded view of the insert, spring and jewelry article of the present invention.
Figure 3:
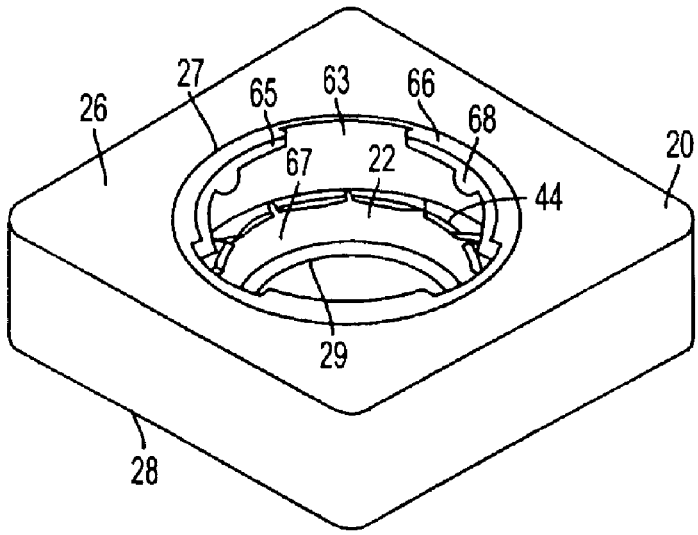
FIG. 3 is a perspective view of the assembled insert, spring and article of jewelry.

First, as shown in FIGS. 2 and 3, the spring 40 and insert 60 are seated within an orifice 21 provided in the article of jewelry 20 and fastened thereto, such that the spring 40 is seated on the recessed surface 22 and the bottom edge surface 62 of the insert 60 is seated on the spring rim 42. Such orifice 21 is defined by a seating surface 22, a side surface 24, an inner surface 26 having an inner opening 27, and an outer surface 28 having an outer opening 29. The terms "outer" and "inner" as used herein refer to the position of the article of jewelry 20 as worn on a person's body. In other words, if the article of jewelry 20 is a ring, then when such article is worn on a person's finger, the "outer" surface 28 would be exposed to the world, while the "inner" surface 26 would lie adjacent the person's finger and be hidden from view. The insert 60 is further defined by an inner surface 63, a receiving chamber 67 adapted to receive the setting 80 as described below, and engagement members 65 having downwardly depending projections 68 for engaging the setting 80 as will be described below. The resilient spring tabs 44 that project upwardly toward the seated insert 60, which tabs will be described in detail later, are preferably not contacted by the bottom edge surface 62 of the insert 60. The side surface 64 of the insert 60 is preferably fastened to the inside surface 24 of the article of jewelry by a suitable adhesive such as glue, epoxy or the like, such that the upper edge surface 66 of the insert 60 becomes flush with the inner surface 26 of the article of jewelry 20.

The steps illustrated in FIGS. 2 and 3, i.e., the seating of the spring 40 and insert 60 in an article of jewelry 20, can be performed at the factory when the article 20 is manufactured, or it can be performed later by fashioning an orifice 21 into an existing piece of jewelry. Thus, the insert 60 and article of jewelry 20 can, if desired, be fashioned as a single piece.

Figure 4:
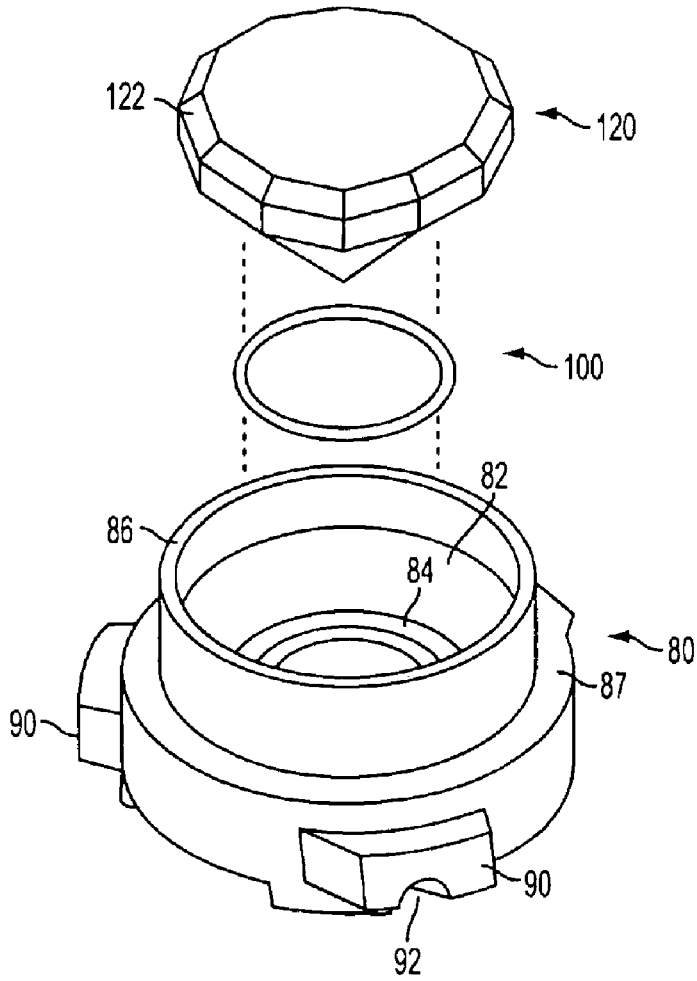
FIG. 4 is an exploded view of the jewel, washer and setting of the present invention.
Figure 5:
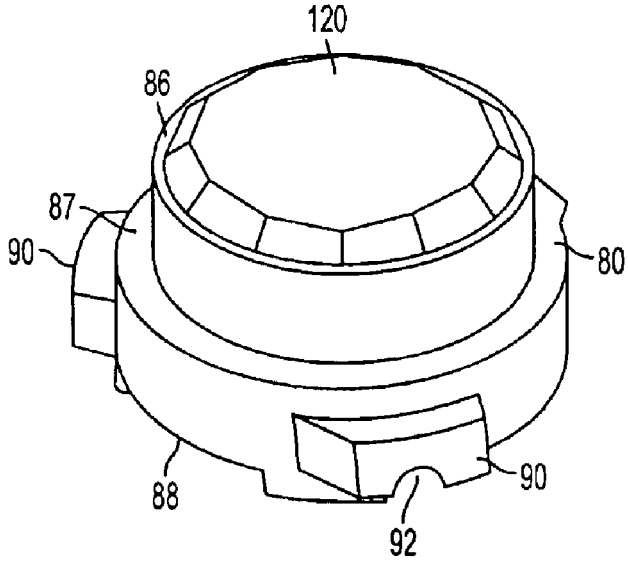
FIG. 5 is a perspective view of the assembled jewel, washer and setting.

The positioning of the jewel 120 within the setting 80 is illustrated in FIGS. 4 and 5. The setting 80 is provided with an orifice 82 adapted to receive the jewel 120 and a seating surface 84 adapted to receive the washer 100. The setting 80 is further provided with an upper edge surface 86, a ledge surface 87, a lower edge surface 88 (see also FIGS. 6A and 6B), and fin-shaped engagement members 90 having pockets 92 fashioned therefrom, which pockets are designed to engage protrusions 68 (see FIGS. 2, 3, 6A) provided on the inside engagement members 65 of the insert 60. The engagement members 90 and the engagement of the setting 80 with the article of jewelry 20 will be described in connection with FIGS. 6A through 8.

Returning to FIGS. 4 and 5, the use of a spring or washer 100 is preferred to protect the seating contact between the jewel 120 and the setting 80, however such use is not critical and it may be left out of the construction as desired. Such element 100 may either be a simple rubber washer or a spring akin to spring 40. In certain situations, the use of a washer may be desirable. For example, a washer 100 will not show through a real diamond but will show through a fake diamond, such as a cubic zirconia. Thus, the washer 100 may be used to verify the type of jewel 120 placed within the setting 80. However, if it would be inappropriate to use a washer, then a spring may be used instead.

In any event, once the jewel 120 is set within the setting 80, the upper edge 86 of the setting 80 is used to fix the jewel 120 in place. Such fixation may comprise the bending of the upper edge material over the crown 122 of the jewel 120 or the use of prongs (not shown) folded over the crown 122. Alternatively (not shown), the jewel 120 may be inserted through the underside of the setting 80 (necessitating the use of a setting having the means to allow for passage of the jewel therethrough) and secured to the setting with a type of filling material. Such type of fixation would allow the person setting the jewel 120 to first check if the jewel 120 fits perfectly through the opening defined by the upper edge 86 of the setting. Otherwise, the upper edge material folded over the crown 122 may cover the crown 122 too much or it may not cover enough of the crown 122 to fix the jewel in place on the setting 80. Other methods of fixation are contemplated.

Figure 6A:
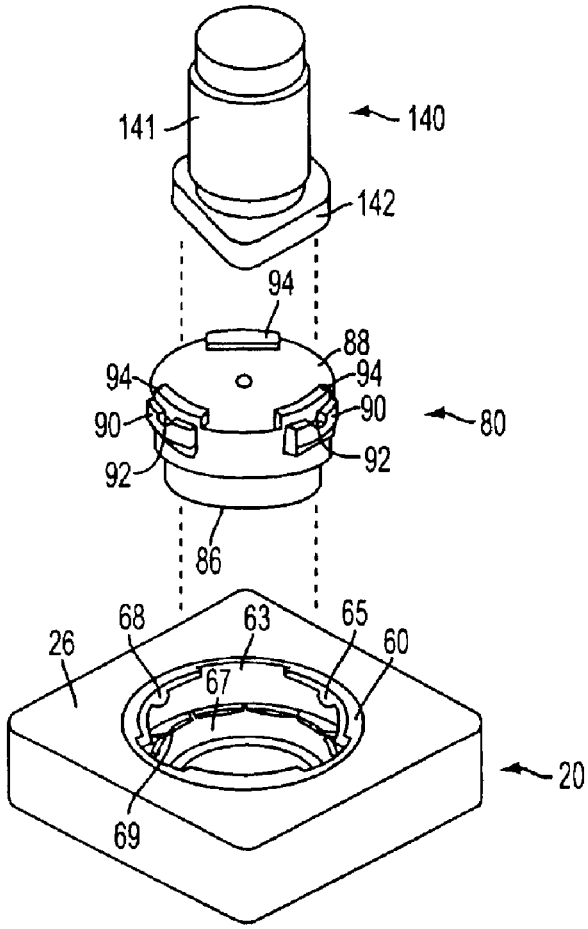
FIG. 6A is an exploded view of the components used to assemble the jewelry setting of the present invention.
Figure 6D:
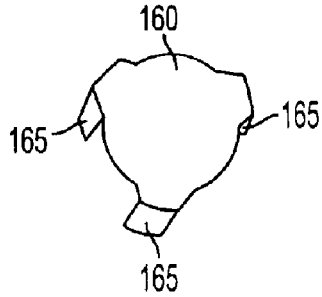
FIG. 6D illustrates a plug or cover used to prevent the setting of the invention from rotating within the insert once the insert is fit within the setting.
Figure 6B:
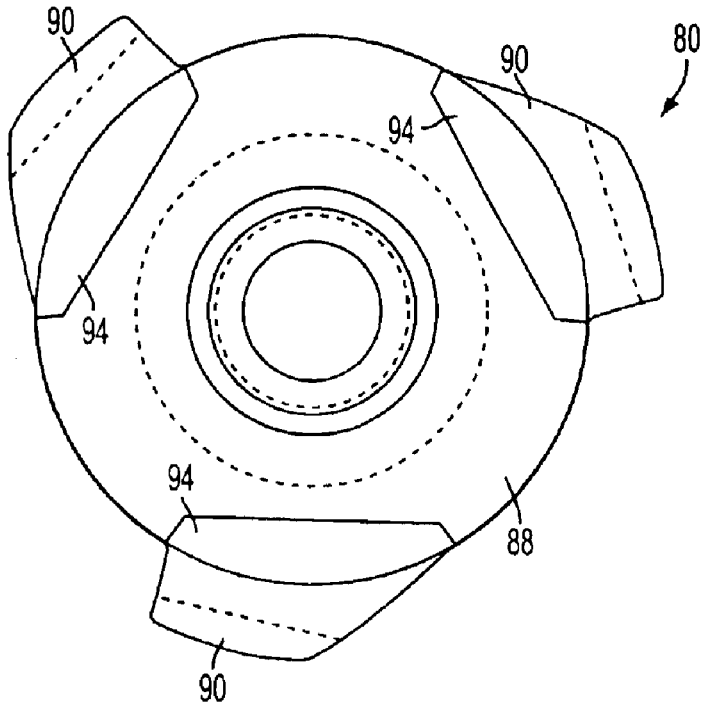
FIG. 6B is a bottom view of the setting of FIG. 1.

Once the jewel 120 is assembled within the setting 80, the setting 80 and jewel 120 combination is engaged with the article of jewelry 20 as shown in FIGS. 6A through 8. The lower edge surface 88 (FIG. 6B) of the setting 80 is provided with a plurality of ledges 94 that define along said lower edge surface 88 a seat adapted to receive a key 140 having a handle 141 and contact portion 142 for facilitating manipulation of said setting 80 during engagement and disengagement with said insert 60. In other words, the contact portion 142 of the key 140 is designed to securely fit within the opening defined along lower edge surface 88 of the setting and bounded by the ledges 94. The setting 80 is insertable into the receiving chamber 67 of the insert 60 by aligning the engagement members 90 with the openings defined along the upper edge surface 66 of the insert 60 (FIG. 6C). As shown in FIGS. 6A through 6C, such alignment can only occur if the setting 80 is inserted with the upper edge surface 86 facing the insert 60 and the lower edge surface 88 facing away from the insert 60. In other words, the setting 80 cannot be mistakenly or improperly inserted into the insert 60 starting with the lower edge surface 88 because of the unique design of the upper edge surface 66 openings and the mating design of the engagement members 90.

Figure 7B:
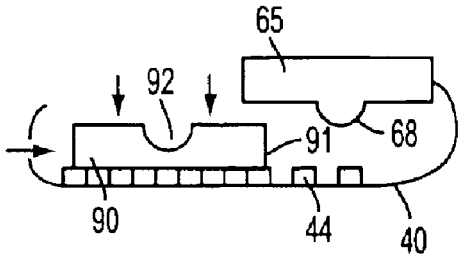
FIGS. 7A–7C illustrate engagement of the setting of the invention with the insert of the invention.
Figure 7C:
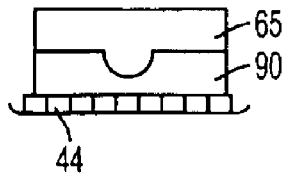
Figure 6C:
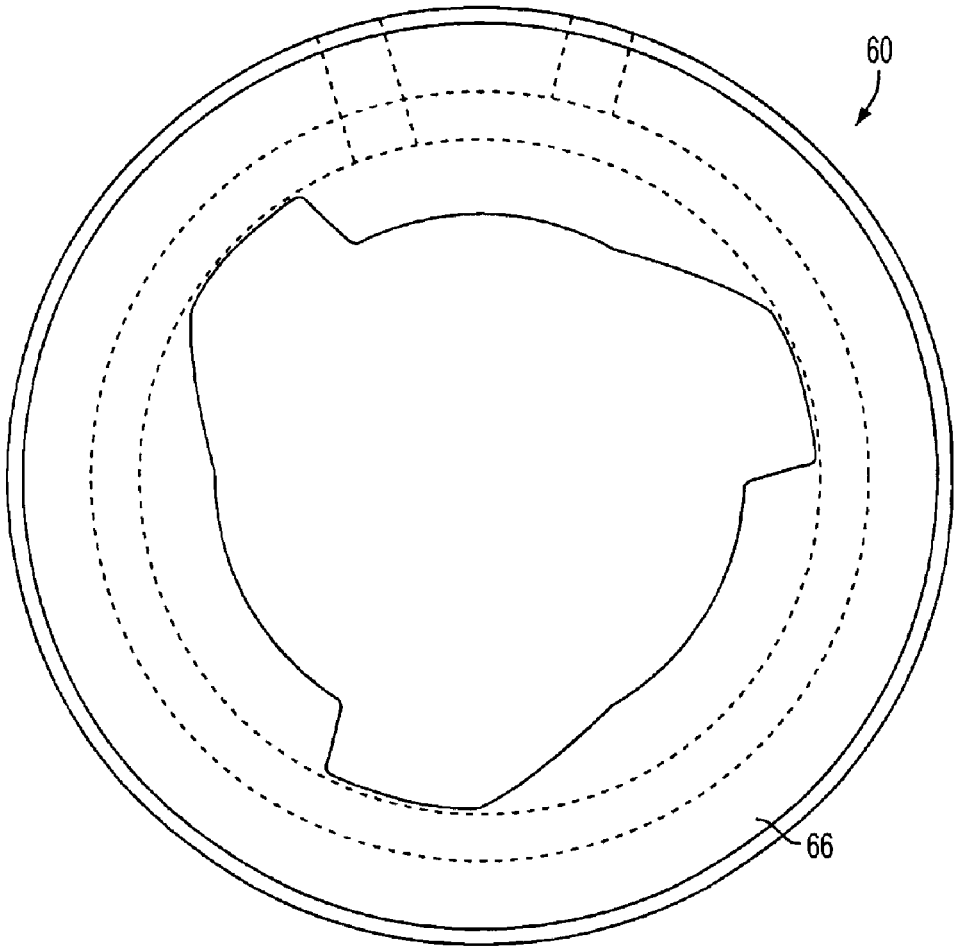
FIG. 6C is a top view of the insert of FIG. 1.
Figure 7A:
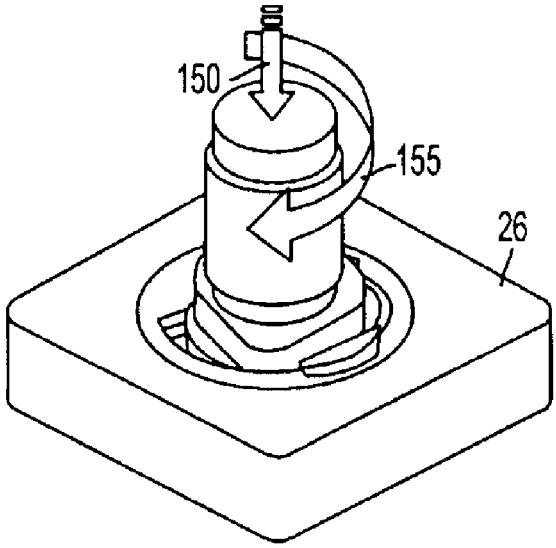
Figure 8:
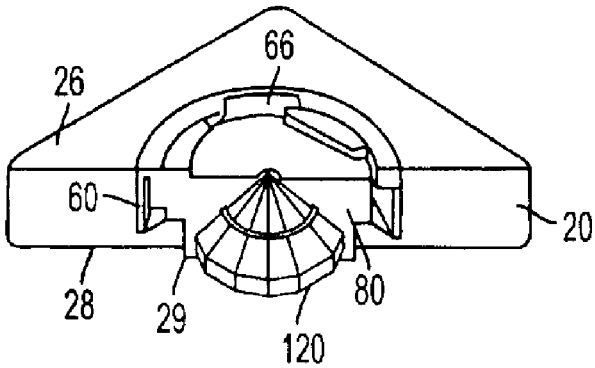
FIG. 8 is a partial section view of the assembled components of FIG. 1.

As shown in FIGS. 7A through 8, the setting 80 is then hand-inserted into the receiving chamber 67 of the insert 60 by the passage of the engagement members 90 through the upper edge surface 66 openings, with the ledge surface 87 of the setting 80 coming into contact with the spring tabs 44 of the spring 40. Then, using the key 140 engaged with the lower edge surface 88 of the setting, the setting 80 is pushed (arrow 150 of FIG. 7) further into the insert 60 against the spring tabs 44 and rotated (arrow 155 of FIG. 7) until the projections 68 present along the insert engagement members 65 are seated within the pockets 92 present along the setting engagement members 90. Stop surfaces 69 fashioned into the inner surface 63 of the insert 60 prevent over-rotation of the setting 80 with respect to the insert 60. FIGS. 7B through 7C are illustrative of the mating between the engagement members 65 and 90. When the setting 80 is first introduced into the insert 60, mere rotation of the setting 80 within the insert 60 would not result in engagement of the projections 68 and pockets 92 because the edge 91 of the engagement member 90 would contact the projection 68 as a result of the engagement member 90 being initially biased toward the engagement member 65. Thus, by pressing against the spring tabs 44, the setting 80 is displaced enough so that the projection 68 can clear the setting engagement member 90, during rotation of the setting 80 with respect to the insert 60. Upon release of the key 140 from the setting 80, the spring 40 biases the projections 68 against the pockets 92. Alignment of the projections 68 and pockets 92 can occur by varying the displacement of the spring tabs 44 such that the projections 68 snap into place within the pockets and/or by taking advantage of the stop surfaces 69 fashioned into the inner surface 63 of the insert.

As shown in FIG. 8, the setting 80 with jewel 120 is inserted into the receiving chamber 67 of the insert 60 and the article of jewelry 20 such that the jewel 120 is exposed along the outer surface 28 of the article of jewelry 20. In other words, the jewel 120 that is fixed within the setting 80 is inserted from the underside of the article of jewelry 20, such that it becomes impossible to remove the setting 80 and jewel 120 while the article of jewelry 20 is being worn. This is realized because the opening 29 defined along the outer surface 28 of the article of jewelry 20 is dimensioned to allow passage of the crown 122 of the jewel 120, but prevent complete passage of the setting 80 therethrough. In other words, the opening 29 present along the outer surface 28 of the article of jewelry 20 and through which the jewel 120 extends is smaller than the opening 27 present along the inner surface 26 through which the setting 80 and jewel 120 is initially passed. Such disparity between the openings 27/29 dimensions provides further security against inadvertent separation of the jewel 120 from the article of jewelry 20 while such article of jewelry 20 is being worn.

For even greater security, an additional cover or plug 160 (FIG. 6D) can be inserted into the upper edge surface openings 66 of the insert 60 after the setting 80 is engaged with the insert 60 to completely prevent the setting 80 from rotating within the insert 60. Downward extensions 165 are preferably configured for insertion through the upper edge surface openings 66 of the insert 60, which would prevent the engagement members 90 from rotating within the receiving chamber 67. Such extensions 165 may be dimensioned to fit exactly within the openings 66. Thus, not only would the plug 160 prevent the setting 80 from turning, but also it would provide further security against inadvertent separation of the jewel 120 from the article of jewelry 20 while such article of jewelry 20 is being worn.

When it is desired to remove the jewel 120 from the jewelry article 20, one merely removes the jewelry article 20 from one's body and uses the key 140 to again press inwardly and also to counter-rotate the setting 80 within the insert 60 until the engagement members 90 are aligned with the openings disposed along surface 66. Then, the jewel 120 and setting 80 may be pushed through the jewelry article 20 by applying finger pressure to the crown 122 of the jewel 120.

Figure 9:
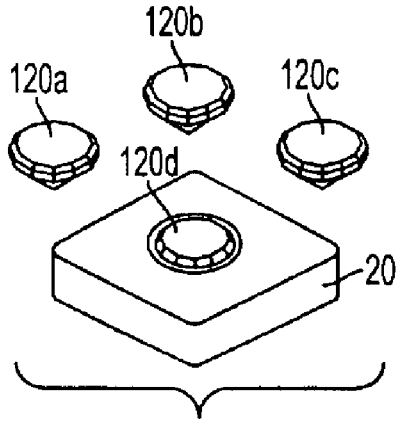
FIG. 9 illustrates a plurality of jewels interchangeably associated with a jewelry article.

The present invention has been described with respect to one article of jewelry 20 containing one insert 60 into which is inserted one jewel 120 fastened to one setting 80. However, it will clearly be understood that the present invention can be defined as a system of interchangeable jewels and articles of jewelry. For example, a plurality of inserts 60 may be provided on a plurality of jewelry articles, such as a pin, a brooch and a bracelet for example. Each jewelry article having an insert 60 of the invention is then adapted to receive a jewel 120 set within the setting 80 of the invention. Thus, one may wear one particular jewel on a ring one day, then on a bracelet the next day, and so on. In other words, the jewel 120 set within the setting 80 of the invention may be transported and used interchangeably with various articles of jewelry. Alternatively, as illustratively depicted in FIG. 9, a plurality of jewels 120*a–d* set within settings 80 (not shown) of the invention may be used with a single article of jewelry 20.

Figure 12:
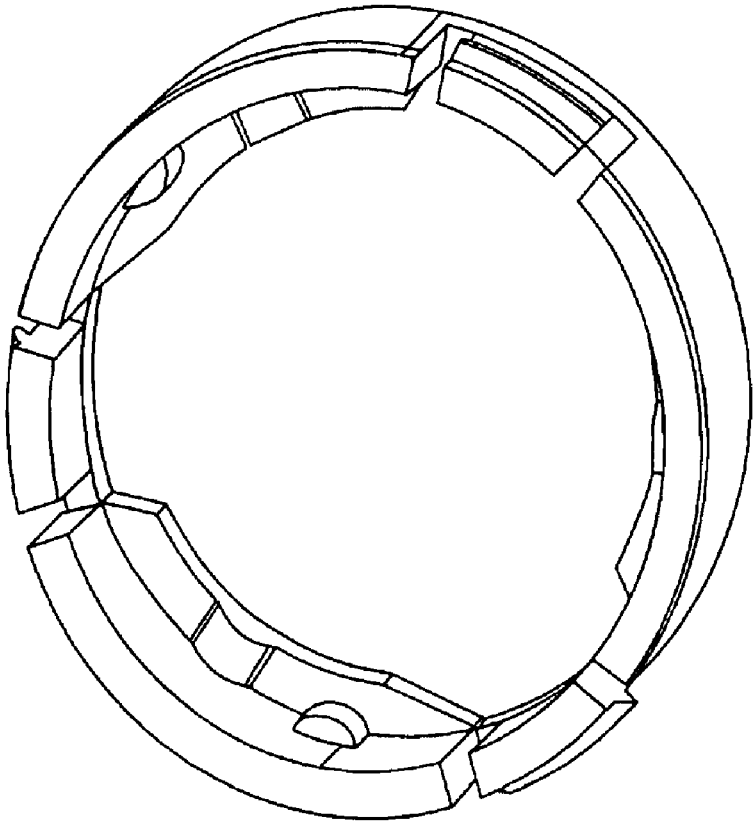
FIG. 12 illustrates an alternative embodiment of the insert of the present invention.

While the present invention has been described with respect to one particular embodiment, it is not intended that it should be limited to such embodiment. For example, while the engagement members 90 on the setting 80 and the openings provided on the upper edge surface 66 of the insert 60 are fin-shaped, such engagement members and openings may comprise alternative shapes (see, for example, the insert configuration of FIG. 12, which illustrates one possible insert embodiment with other embodiments being contemplated). Also, such engagement members might comprise a single engagement member or a plurality as shown. Although it is preferable that the configuration of the engagement members 90 and the configuration of the openings allow the setting 80 to be inserted into the insert 60 in only one direction as discussed above. In addition, the engagement between the engagement members on the insert and the setting may comprise different configurations in addition to the use of a projection 68 seated within a pocket 92 as described.

Figure 10:
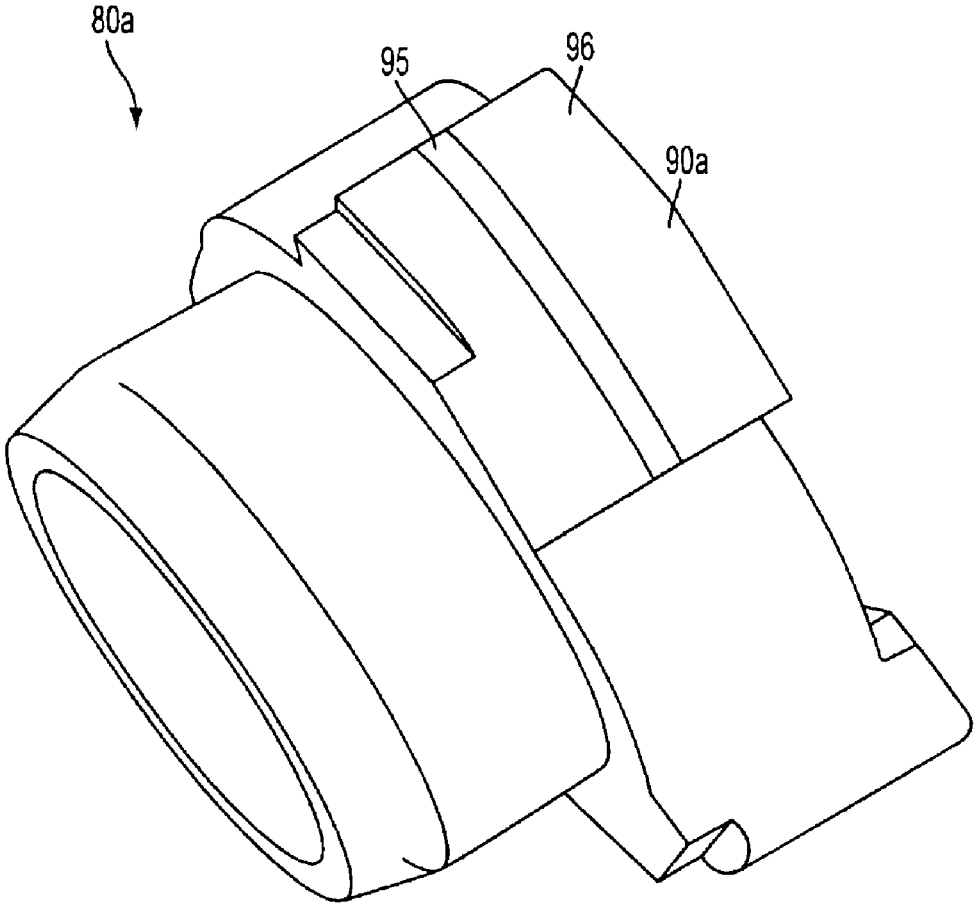
FIG. 10 is a perspective view of an alternative design of the setting member of the invention.
Figure 11:
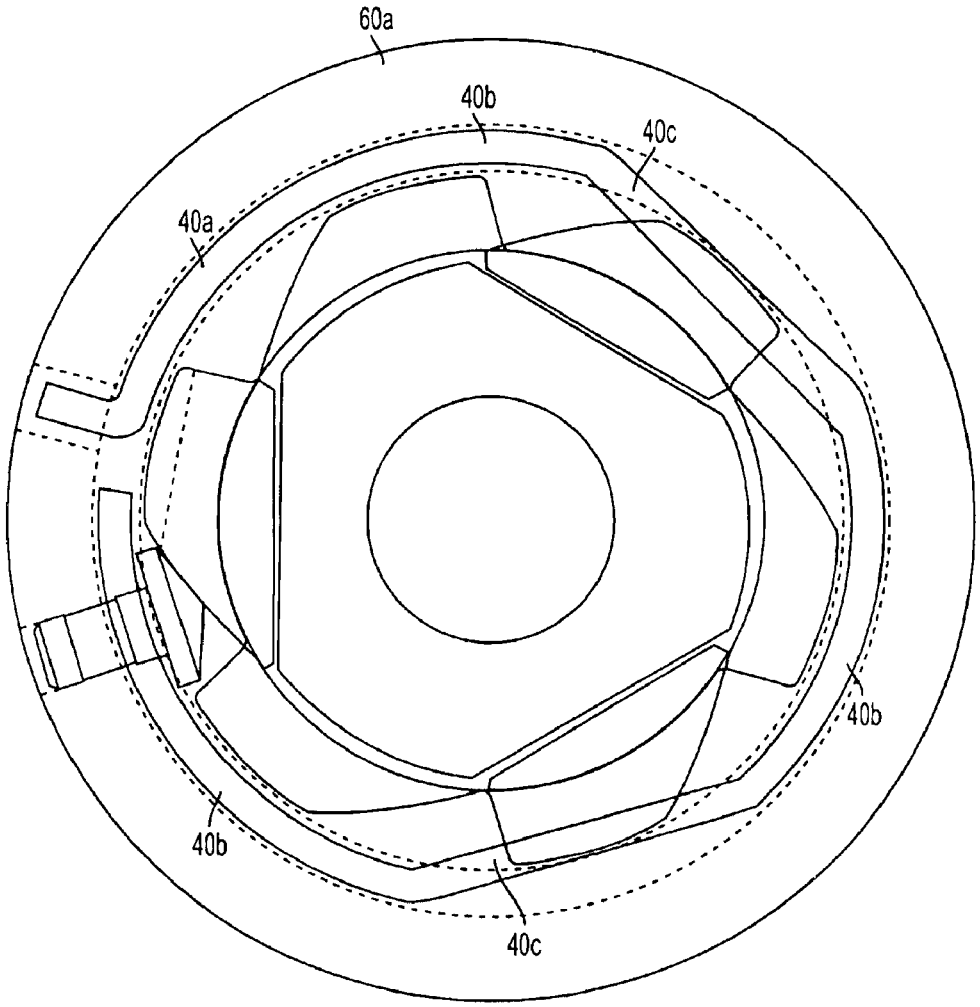
FIG. 11 is a partially hidden assembly view of the setting of FIG. 10 position in an insert of the invention.

Furthermore, the spring 40 may comprise different configurations to facilitate engagement and disengagement of the setting 80 with the insert 60. One illustrative example is shown in FIGS. 10 and 11, where a uniquely designed spring 40*a*, having rounded sections 40*b* and flattened, chordal sections 40*c*, is disposed around the perimeter of the inner surface 63 of the insert 60*a* and is adapted to engage grooves 95 fashioned into the side surfaces 96 of the engagement members 90*a*. Upon initial introduction of the setting 80*a* into the receiving chamber of the insert 60*a*, the grooves 95 do not engage the spring 40*a* because such grooves 95 are disposed adjacent the rounded sections 40*b* of the spring. However, upon rotation of the setting 80*a* within the insert 60*a*, the grooves 95 engage the chordal sections 40*c* of the spring 40*a* which act to resiliently bias against the rotation of the setting 80*a*. Thus, the secure engagement of the setting 80*a* within the insert 60*a* results from the movement of the grooves 95 against the straight sections 40*c* of the spring 40*a*. If necessary, a stop surface or member may be provided in the insert 60*a* to prevent over-rotation of the setting 80*a* within the insert 60*a*.

Figure 13:
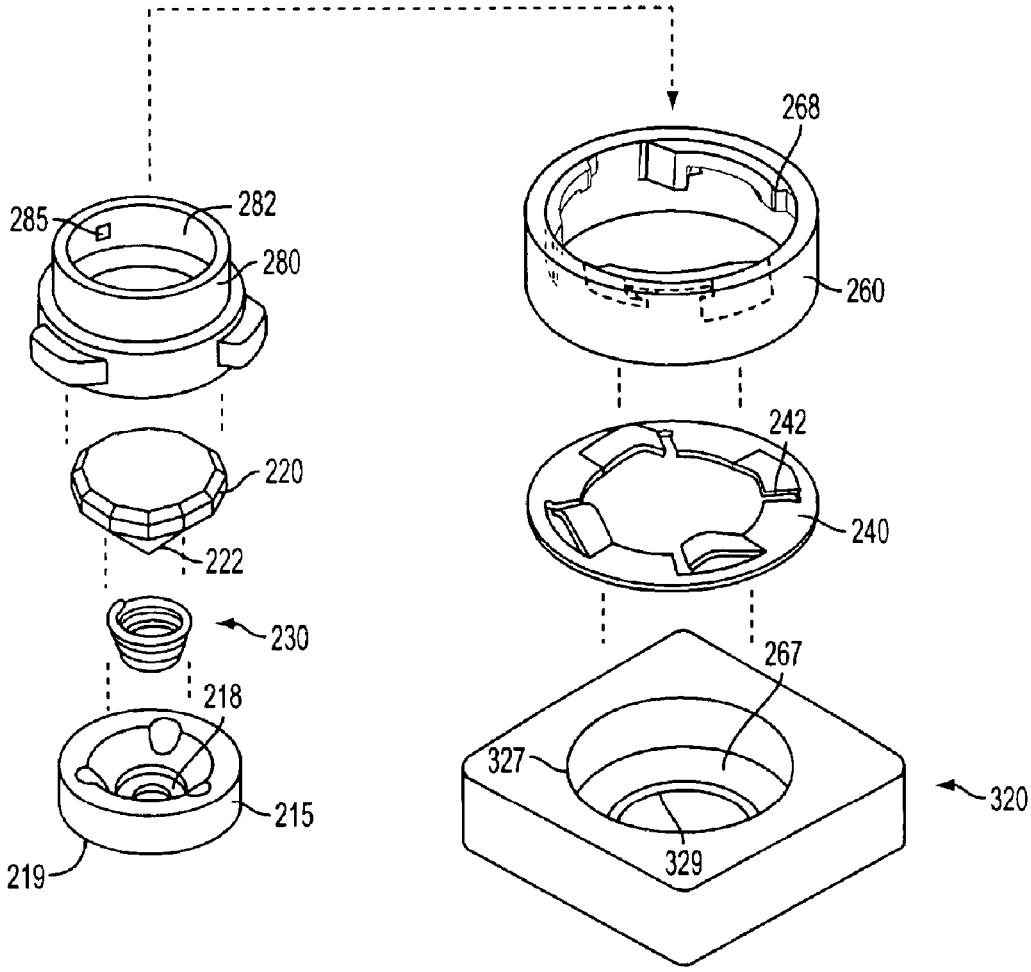
FIG. 13 is an exploded view of an alternative embodiment of the components of the jewelry setting of the present invention.

FIG. 13 illustrates yet a further embodiment of the present invention. In this embodiment, a jewel is fastened to a setting via a spring, not a washer, while the components that are seated within the jewelry item have a different configuration as compared with the embodiment described above.

A setting 280 is provided with a hole 282 out of which the top of the jewel 220 will protrude. The jewel or gem 220 (faced downward) is placed into the setting 280 (upside down) and a spring 230 is placed onto the tip 222 of the gem 220. A cover 215, having a depression 218 to accommodate the spring 240, is then fastened to the setting 280 and optionally, the cover 215 and setting 280 can be soldered by laser or glued together to add extra security. Other means of attaching the cover 215 to the setting 280, such as by having a threaded connection between the two, are also contemplated. The combination of the setting 280, gem 220, spring 230 and cover 215 forms the "male" piece of the interchangeable jewelry. The "female" piece, which is secured within a jewelry item 320 such as ring, brooch or the like, is formed by an insert 260.

Figure 14:
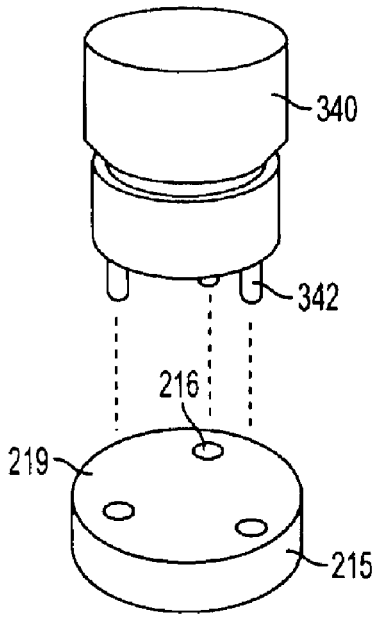
FIG. 14 is an exploded view of a tool engaging a component of the invention.

A flat spring 240 is positioned within a cavity 267 in the jewelry item 320 and the insert 260 is positioned thereon and secured within the cavity 267. The setting 280, having the gem 220 secured therein, is then forced into the insert cavity 268 until the setting 280 abuts the spring 240. Afterward, the setting 280 is pushed against the prongs 242 of the spring and rotated until the setting 280 locks into the insert 260. As shown in FIG. 14, the setting 280 may be driven through the use of a tool 340 having fingers 342 that engage openings 216 in the rear surface 219 of the cover 215. The unusual arrangement of openings 216 and tool fingers 342 ensures that only those individuals with special tools will be able to engage and disengage the setting 280 from the insert 260. It should be appreciated that the engagement of the setting 260 with the jewelry item 320 and the setting 280 with the insert 260, to form a combined jewelry item that can be worn and displayed, is generally similar to the engagement of such items illustrated in the previous embodiments.

A system of jewels, settings and inserts is contemplated. For instance, every jewelry item 320 has two openings 327 and 329. The insert 260 is inserted through opening 327, while the gem 220 sticks out through opening 329. In order to benefit from the interchangeable nature of the inventive system, and in order to use multiple gems with a single jewelry item, the thickness of the setting 280 may vary to accommodate gems of different sizes such that multiple gem settings can be used with a single insert 260. If, for example, a woman has five gems having diameters ranging from 4.00 mm to 5.20 mm, each individual gem can be secured within an individual setting 280 that can accommodate gems of varying diameters ranging from 4.00 mm (0.25 carats) to 5.3 mm (0.50 carats), such that the various settings, having individual gems secured therein, can be used with a single insert 260. The interior thickness of the setting 280 would differ depending on the diameter of the gem, but the exterior diameter of the setting would remain the same so that the multiple settings could be used with a single insert.

In accordance with the above, a variety of sizes of gems, settings and inserts are contemplated. For example, one setting/insert size could accommodate stones of 4.0 mm (0.25 carats) to 5.3 mm (0.50 carats), another setting/insert size could accommodate stones of 5.4 mm (0.50 carats) to 6.7 mm (1 carat), while another setting/insert size could accommodate stones of 1–2 carats and 2–3 carats. For each size range, a series of settings 280 would be manufactured to fit within a particularly sized insert. The advantage of this system is fairly clear. Instead of a jeweler enlarging a hole on a jewelry item to accommodate a larger jewel, the jeweler merely has to place the jewel in a different setting 280 and then attach such setting 280 to the insert that is already in place in the jewelry item. Of course, this would only work for particular ranges of sizes. Going from a 0.25 carat jewel to a 3 carat jewel would obviously require a jewelry item (ring, brooch or the like) having a substantially larger opening 267 and a correspondingly larger setting 260. However, if, continuing with the example above, a woman goes from a 0.25 carat jewel to a 0.50 carat jewel, the same insert 260 can be used in the jewelry item and the opening in the jewelry item does not have to be modified.

FIG. 13 also illustrates the use of an identification means 285 associated with a setting 280. Currently there are companies that put a serial number on a diamond with a micro laser inscription. This process, although it allows for identification, leaves a microscopic mark on the stone. With the present invention, the identification means 285 could be on the setting 280, and such identification means 285 could be sealed by a particular sealing means such that if the seal is broken, the value of the identification becomes void. One type of means 285 could be inserting a chip onto the surface or into the body of the setting 280. Such chip might be a microchip that is essentially hidden from view and can be programmed with personalized information. With such a chip incorporated into the setting 280 as an identification means 285, the integrity of the setting 280 and gem 220 associated therewith can be assured and insured without damaging the gem 220 in any way. Other identification means placed on a surface of the setting or on other components of the inventive system, such as a barcode, inscription or the like, are also contemplated. As long as the sealing means remains unbroken, the identification means can guarantee that the setting 280 and gem 220 are original, bona fide products and not fake or imitations of the inventive system.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A system for the retention of a jewel, whereby a plurality of jewels may interchangeably set in an article of jewelry, the system comprising:

a) a fixed portion housed within an article of jewelry, the fixed portion comprising a receiving chamber and a biasing member, b) a removable portion comprising a seat portion for retaining a jewel and comprising an insertion member adapted for insertion into the receiving chamber, c) the fixed portion further comprising an outer end exposed during the wearing of the article of jewelry, an inner end hidden during the wearing of the article of jewelry, and an inner wall having securing means and being disposed between the inner end and the outer end;

d) the fixed portion adapted for passage of the insertion member through the inner end and into the receiving chamber for seating of the removable portion within the fixed portion and for displaying of the jewel seated within the seat portion adjacent the outer end, the fixed and removable portions extending along a longitudinal axis upon insertion of the insertion into the fixed portion, the removable portion being seated relative to the fixed portion through a rotatable engagement of the insertion member with the securing means on the inner wall of the fixed portion;

e) wherein the insertion member engages the biasing member upon rotation of the removable portion within the fixed portion, and the biasing member generates an axially longitudinally directed force for urging the fixed and the removable portions to remain seated so that the fixed and removable portions are prevented from axial displacement relative to one another while seated; and f) wherein the insertion member has a predefined shape and the inner end has a plurality of passages that form a pattern of passages, each passage of the plurality of passages corresponding in shape to the shape of the insertion member.

2. A system in accordance with claim 1, wherein the outer end and the inner end each have a diameter and the diameter of the outer end is less than the diameter of the inner end for preventing passage of the insertion member completely through the outer end.

3. A system in accordance with claim 1, wherein the at least one insertion member is fin-shaped.

4. A system in accordance with claim 1, wherein the predefined shape and the pattern of passages are configured for unidirectional insertion of the insertion member into the receiving chamber.

5. A system for the retention of a jewel, whereby a plurality of jewels may interchangeably set in an article of jewelry, the system comprising:

a) a fixed portion comprising a receiving chamber and a biasing member, the fixed portion adapted to be housed within an article of jewelry, and b) a removable portion comprising a seat portion adapted to retain a jewel and further comprising at least one insertion member adapted for insertion into the receiving chamber, c) said fixed portion further comprising an outer end, an inner end and an inner wall disposed therebetween, the inner wall having securing means, the outer end adapted for being exposed during the wearing of the article of jewelry and the inner end adapted for being hidden during the wearing of the article of jewelry, d) said fixed portion further adapted for passage of the at least one insertion member through the inner end and into the receiving chamber for seating of the removable portion within the fixed portion and for displaying of a jewel seated within the seat portion adjacent the outer end, the seating of the removable portion occurring through a rotatable engagement of the at least one insertion member with the securing means on the fixed portion inner wall, e) wherein the at least one insertion member engages the biasing member upon rotation of the removable portion within the fixed portion, f) wherein the at least one insertion member has a predefined shape and the inner end has a plurality of passages that form a pattern of passages, each passage of the plurality corresponding in shape to the shape of the at least one insertion member, and g) wherein the biasing member further comprises a substantially annular spring member.

6. A system in accordance with claim 5, wherein the biasing member further comprises at least one chordal section.

7. A system in accordance with claim 6, further comprising at least one groove disposed on the at least one insertion member for biased engagement with the at least one chordal section.

8. A system for the retention of a jewel, whereby a plurality of jewels may interchangeably set in an article of jewelry, the system comprising:

a) a fixed portion comprising a receiving chamber and a biasing member, the fixed portion adapted to be housed within an article of jewelry, and b) a removable portion comprising a seat portion adapted to retain a jewel and further comprising at least one insertion member adapted for insertion into the receiving chamber, c) said fixed portion further comprising an outer end, an inner end and an inner wall disposed therebetween, the inner wall having securing means, the outer end adapted for being exposed during the wearing of the article of jewelry and the inner end adapted for being hidden during the wearing of the article of jewelry, d) said fixed portion further adapted for passage of the at least one insertion member through the inner end and into the receiving chamber for seating of the removable portion within the fixed portion displaying of a jewel seated within the seat portion adjacent the outer end, the seating of the removable portion occurring through a rotatable engagement of the at least one insertion member with the securing means on the fixed portion inner wall, e) wherein the at least one insertion member engages the biasing member upon rotation of the removable portion within the fixed portion, f) wherein the at least one insertion member has a predefined shape and the inner end has a plurality of passages that form a pattern of passages, each passage of the plurality corresponding in shape to the shape of the at least one insertion member, and g) wherein the biasing member comprises a plurality of tab sections that are biased toward the inner end of the fixed portion.

9. A system in accordance with claim 1, further comprising a stop surface disposed on the inner wall in the receiving chamber to limit rotation of the removable portion within the fixed portion.

10. A system in accordance with claim 1, wherein the receiving member is adapted for the through passage of a jewel seated within the seat portion only from the inner end to the outer end.

11. A system in accordance with claim 1, further including the article of jewelry and wherein the first portion is integrally mounted within the article of jewelry.

12. A system in accordance with claim 1, further including a jewel, the jewel being fixedly in the seat portion.

13. A system in accordance with claim 1, further comprising a facilitator tool for engaging the removable portion to engage or disengage the removable portion with the fixed portion.

14. An article of jewelry comprising:

a) a retaining chamber comprising an outer end having an outer end opening and an outer end opening dimension and an inner end having an inner end opening and an inner end opening dimension, the inner end opening having a plurality of passages that form a pattern of passages;

b) a biasing member disposed between the inner and outer ends;

a setting comprising a jewel seat for a jewel and comprising an engagement portion; the jewel seat for passage through the outer end opening, the engagement portion having a plurality of insertion members for axial insertion through the plurality of passages and into the retaining member through the inner opening for displaying the jewel proximate to the outer opening each of the plurality of insertion members having a predefined shape that corresponds with the inner end opening passage, c) and the engagement portion engaging the retaining member through a rotation of the setting within the retaining member; and d) wherein the retaining member and the setting extend along a longitudinal axis upon insertion of the setting into the retaining member, and the biasing member generates an axially longitudinally directed force for urging the retaining member and the setting to remain engaged so that the retaining member and the setting are prevented from axial displacement to one another while engaged.

15. An article of jewelry in accordance with claim 14, wherein the outer end opening dimension is smaller than the inner end opening dimension to prevent the complete passage of the setting through the outer end opening.

16. An article of jewelry in accordance with claim 14, wherein the pattern of passages and the plurality of insertion members are fin-shaped.

17. An article of jewelry in accordance with claim 14, wherein the plurality of insertion members are symmetrically and radially disposed around the setting.

18. An article of jewelry in accordance with claim 14, further comprising at least one additional setting comprising an additional jewel seated thereon and adapted for removable engagement with the retaining member.

19. An article of jewelry in accordance with claim 14, further comprising a facilitator tool for engaging the setting to engage and disengage the setting with the retaining member.

20. An article of jewelry in accordance with claim 14, further comprising a washer disposed between the jewel and the jewel seat.

21. An article of jewelry in accordance with claim 14, further comprising a cover engageable with the article of jewelry to prevent rotation of the setting within the retaining member and to prevent removal of the setting from the retaining member once the engagement portion is secured within the retaining member.

22. A jewelry system comprising:

a) a plurality of jewels set within a plurality of settings, and b) a jewelry article having a receiving member for individually and interchangeably receiving each of the plurality of settings, the receiving member having an insertion end, a display end biasing member and a rotation stop, the insertion end having a plurality of passages including an insertion end opening passage, the plurality of passages forming a pattern of passages, each of the plurality of settings including a plurality of insertion member, each of the plurality of insertion members having a predefined shape, the predefined shape corresponding with the insertion end opening passage;

c) wherein each of the plurality of settings is axially insertable through at least one of plurality of passages of the plurality of insertion members each of the plurality of settings being engaged by the rotation of each of the plurality of settings with the receiving member until the rotation is inhibited by the rotation stop;

d) wherein the receiving member is dimensioned and configured to prevent passage of each of the plurality of settings completely through the display end; and e) wherein the receiving member and each of the plurality of settings extend along a longitudinal axis upon insertion of each of the plurality of the settings into the receiving member, and the biasing member generates an axially longitudinally directed force for urging the receiving member and each of the plurality the settings to remain engaged so that the receiving member and each of the plurality the settings are prevented from axial displacement related to one another while engaged.

23. A jewelry system in accordance with claim 22, further comprising a plurality of jewelry articles each interchangeably engageable with the plurality of settings.

24. A jewelry system in accordance with claim 22, further comprising means for identifying the plurality of settings.

25. A jewelry system in accordance with claim 24, further comprising means for sealing the identifying means for insuring the integrity of the identifying means and the relationship of the identifying means with a respective setting.

26. An article of jewelry in accordance with claim 14, further comprising means associated with the setting for identifying the jewel secured within the setting.

27. An article of jewelry in accordance with claim 26, further comprising means for sealing the identifying means for ensuring the integrity of the identifying means relative to the setting.

28. An article of jewelry in accordance with claim 26, wherein the identifying means is a microchip.

29. An article of jewelry in accordance with claim 28, wherein the microchip is programmable with user information.

30. An article of jewelry in accordance with claim 26, wherein the identifying means is a barcode placed on a surface of the setting.

31. An article of jewelry in accordance with claim 26, wherein the identifying means is an engraving placed on a surface of the setting.

* * * * *